US012121107B2

(12) United States Patent
Putzke

(10) Patent No.: US 12,121,107 B2
(45) Date of Patent: Oct. 22, 2024

(54) APPARATUS AND METHOD FOR STORING FOOTWEAR

(71) Applicant: Michael Putzke, Paynesville, MN (US)

(72) Inventor: Michael Putzke, Paynesville, MN (US)

( * ) Notice: Subject to any disclaimer, the term of this patent is extended or adjusted under 35 U.S.C. 154(b) by 226 days.

(21) Appl. No.: 17/992,579

(22) Filed: Nov. 22, 2022

(65) Prior Publication Data

US 2024/0164473 A1 May 23, 2024

(51) Int. Cl.
*A43B 5/04* (2006.01)
*A45F 5/10* (2006.01)

(52) U.S. Cl.
CPC ..... *A43B 5/0425* (2013.01); *A45F 5/10* (2013.01)

(58) Field of Classification Search
CPC ..... A43B 5/0425; A45F 5/10
USPC ..... 224/250
See application file for complete search history.

(56) References Cited

U.S. PATENT DOCUMENTS 3,187,357 A 6/1965 McCabe
3,259,284 A * 7/1966 Olson ..... A43B 5/0425 294/142
3,587,951 A * 6/1971 Derouin ..... A43B 5/0425 294/166
3,636,594 A * 1/1972 Faivre ..... B65D 63/14 24/715.4
3,653,565 A * 4/1972 McAusland ..... A63C 11/023 294/166
3,797,369 A 3/1974 Hnatko
3,987,357 A 2/1976 Thompson
4,242,813 A * 1/1981 Quance ..... A63C 11/023 294/143
4,483,470 A * 11/1984 Cousins ..... A45F 3/14 294/149
4,669,772 A * 6/1987 Waller, Jr. ..... A47G 25/005 294/146
4,867,359 A * 9/1989 Donovan ..... A63C 11/023 224/264
5,513,787 A * 5/1996 Reed ..... A63C 11/023 224/602
5,785,223 A * 7/1998 Matsushita ..... A63C 11/023 D3/261
5,853,213 A * 12/1998 Simpson ..... A63C 17/00 294/170
5,908,206 A * 6/1999 LoPresti, Jr. ..... A63C 11/023 224/220
6,182,382 B1 * 2/2001 Skinner ..... A43D 3/14 12/128 R
6,446,849 B1 * 9/2002 Schleifer ..... A45F 3/14 294/149
8,439,415 B2 5/2013 Valaas
9,078,510 B2 * 7/2015 Liao ..... A45F 5/10
9,770,086 B2 * 9/2017 Prisco ..... A45F 3/14
(Continued)

*Primary Examiner* — Peter N Helvey

(57) ABSTRACT

A method for storing footwear includes the extending a first rod into a first foot covering such that a first end of the first rod is in a toe area of the first foot covering and a second end of the first rod is positioned in a heal area of the first foot covering. A second rod is extended into a second foot covering such that a first end of the second rod is in a toe area of the second foot covering and a second end of the second rod is positioned in a heal area of the second foot covering. A tether attached to the first ends of the first and second rods is positioned over a support such that the first and second foot coverings are suspended from the support.

3 Claims, 4 Drawing Sheets

(56) References Cited

U.S. PATENT DOCUMENTS

| | | | | |
|---|---|---|---|---|
| 11,089,851 | B2 * | 8/2021 | Leaks, Jr. | A45C 3/12 |
| 11,445,805 | B2 * | 9/2022 | Becht | A45F 3/14 |
| 11,974,656 | B2 * | 5/2024 | Mui | A45F 5/02 |
| 2007/0039841 | A1 * | 2/2007 | Deloatch-Ratliff | A45C 3/12<br>206/278 |
| 2007/0272570 | A1 * | 11/2007 | Brooks | A45C 11/00<br>206/315.9 |
| 2011/0101052 | A1 * | 5/2011 | Armstrong | A45C 13/30<br>224/254 |
| 2023/0276928 | A1 * | 9/2023 | Chu | A45F 5/02<br>224/250 |

* cited by examiner

APPARATUS AND METHOD FOR STORING FOOTWEAR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to footwear storing devices and methods and more particularly pertains to a new footwear storing device for allowing a person to retain a pair of footwear together hang the footwear on hooks or hanging rods. The method further allows for easy transportation of the footwear by tethering the footwear together.

(2) Description of Related Art Including Information Disclosed Under 37 CFR 1.97 and 1.98

The prior art relates to footwear storing devices that are used to organize footwear.

BRIEF SUMMARY OF THE INVENTION

An embodiment of the disclosure meets the needs presented above by generally comprising the extending a first rod into a first foot covering such that a first end of the first rod is in a toe area of the first foot covering and a second end of the first rod is positioned in a heal area of the first foot covering. A second rod is extended into a second foot covering such that a first end of the second rod is in a toe area of the second foot covering and a second end of the second rod is positioned in a heal area of the second foot covering. A tether attached to the first ends of the first and second rods is positioned over a support such that the first and second foot coverings are suspended from the support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
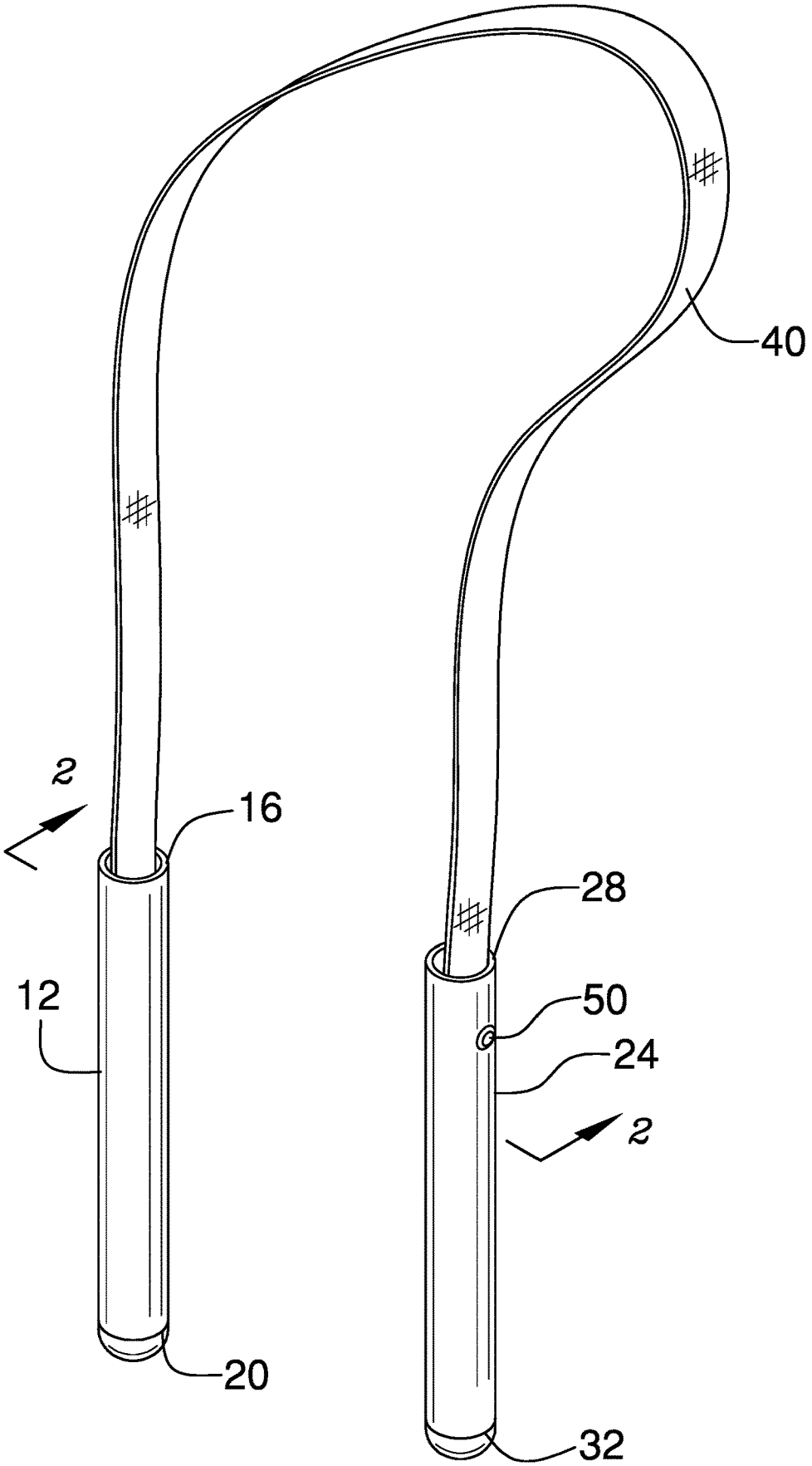
FIG. 1 is a front isometric view of an apparatus and method for storing footwear according to an embodiment of the disclosure.

With reference now to the drawings, and in particular to FIGS. 1 through 5 thereof, a new footwear storing device embodying the principles and concepts of an embodiment of the disclosure and generally designated by the reference numeral 10 will be described.

As best illustrated in FIGS. 1 through 5, the apparatus 10 and method of storing footwear generally comprises extending a first rod 12 into a first foot covering 14 such that a first end 16 of the first rod 12 is in a toe area 18 of the first foot covering 14 and a second end 20 of the first rod 12 is positioned in a heal area 22 of the first foot covering 14. A second rod 24 is extended into a second foot covering 26 such that a first end 28 of the second rod 24 is in a toe area 30 of the second foot covering 26 and a second end 32 of the second rod 24 is positioned in a heal area 34 of the second foot covering 24. The first 14 and second 26 foot coverings may comprise any conventional footwear which typically includes at least a vamp 36 and heal counter 38 for the method 10 to properly work. The heal counter 38 may comprise a heal strap and the vamp 36 may be generally open as might be found in high-healed shoes, for example. Therefore, footwear suitable for the method 10 may include, for example, tennis shoes, men's dress shoes, high-heeled shoes, and all type of boots.

The first 12 and second 24 rods are each elongated and have a length between 5.0 inches and 10.0 inches. In some embodiments, for example, a length of 6.0 inches may be utilized for children's footwear and a length of 8.0 inches is utilized for adult footwear. As is shown in the Figures, one embodiment of the apparatus 10 includes each of the first 12 and second 24 rods may having a cylindrical shape and being comprised of a rigid material such as metals, plastics, wood and the like. However, the first 12 and second 24 rods may include other shapes where a cross-section taken perpendicular to longitudinal axes of the first 12 and second 24 rods may be rectangular, triangular, oval, or have other geometric shapes. Typically a round or rectangular cross-section will be preferred. The first ends 16, 28 of the first 12 and second 24 rods may be open and the first 12 and second 24 rods substantially hollow as shown in FIG. 2.

A tether 40, which is attached to the first ends 16, 28 of the first 12 and second 24 rods, is extended over a support 42 such that the first 14 and second 26 foot coverings are suspended from the support 42. The term "attached to" in this respect refers to the tether 40 extending from or supporting the first 12 and second 24 rods from a position adjacent to the first ends 16, 28 and therefore the tether 40 need not be mechanically coupled directly to the first ends 16, 28. The support 42 may include, for example, a closet hanging rod, hooks or like structures used to hang clothing articles from. The tether 40 has a length from the first rod 16 to the second rod 28 that is typically between 30.0 inches and 60.0 inches. The tether 40 may be comprised of any conventional material used for tethers, ropes and the like. In one embodiment the tether 40 is comprised of a strap consisting of synthetic webbing.

Figure 2:
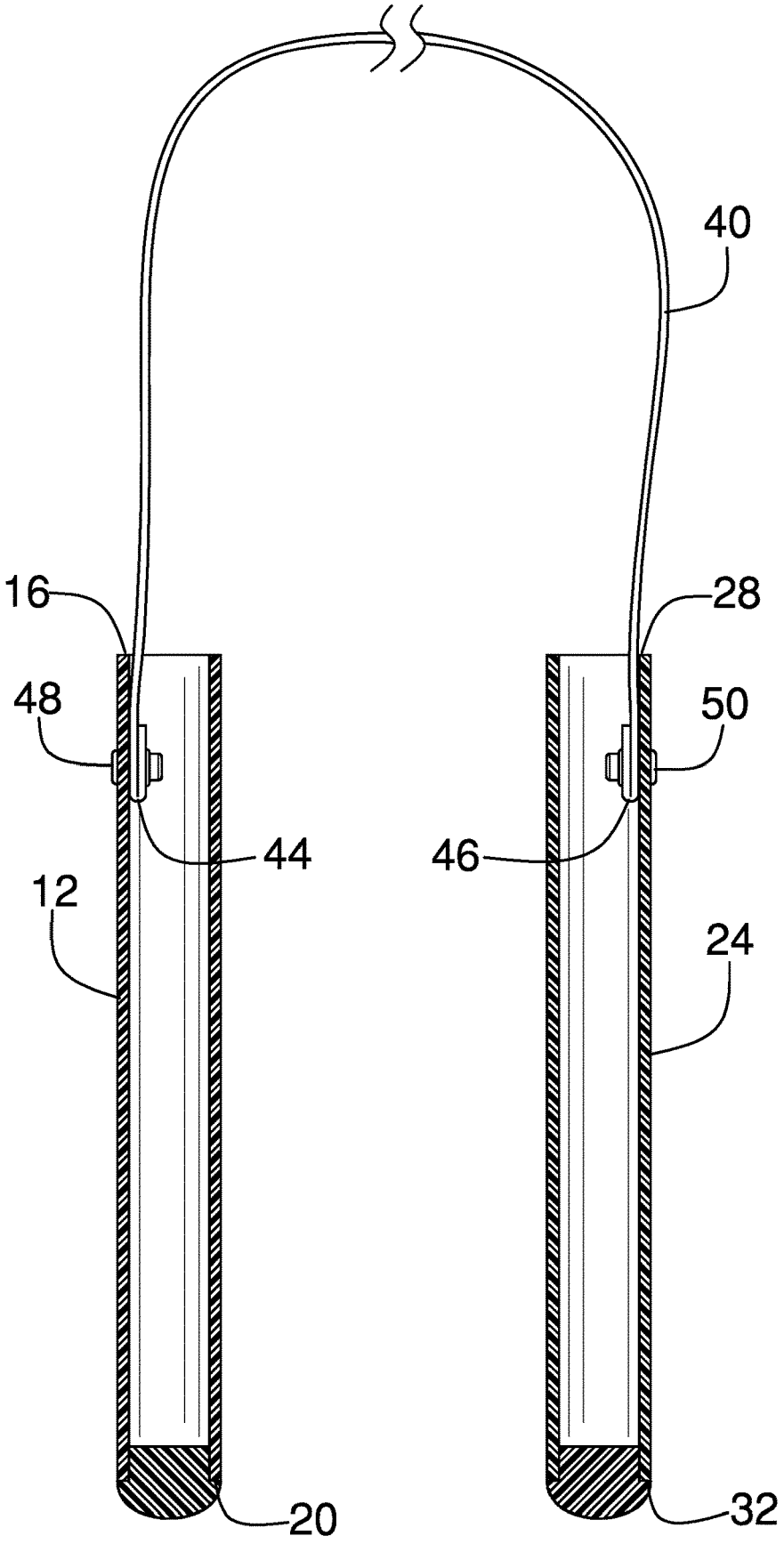
FIG. 2 is a cross-sectional view of an embodiment of the disclosure taken along line 2-2 of FIG. 1.
Figure 4:
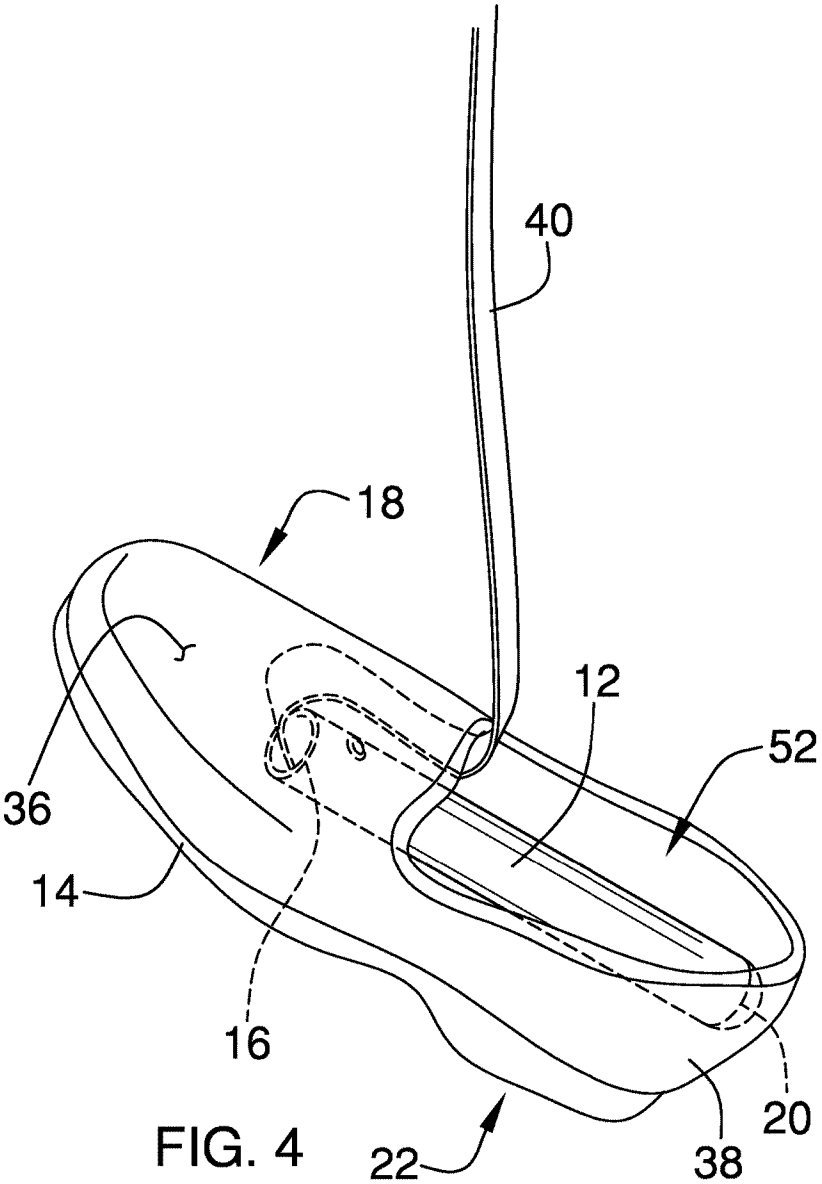
FIG. 4 is an isometric in-use view of an embodiment of the disclosure.
Figure 3:
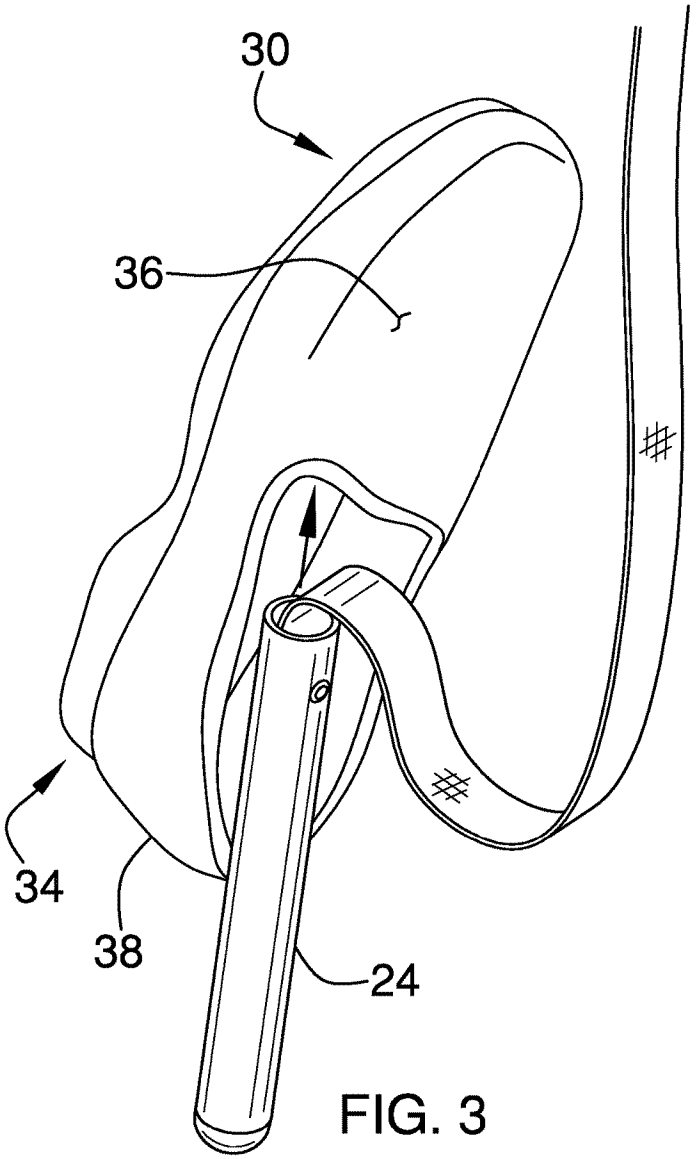
FIG. 3 is an isometric in-use view of an embodiment of the disclosure.
Figure 5:
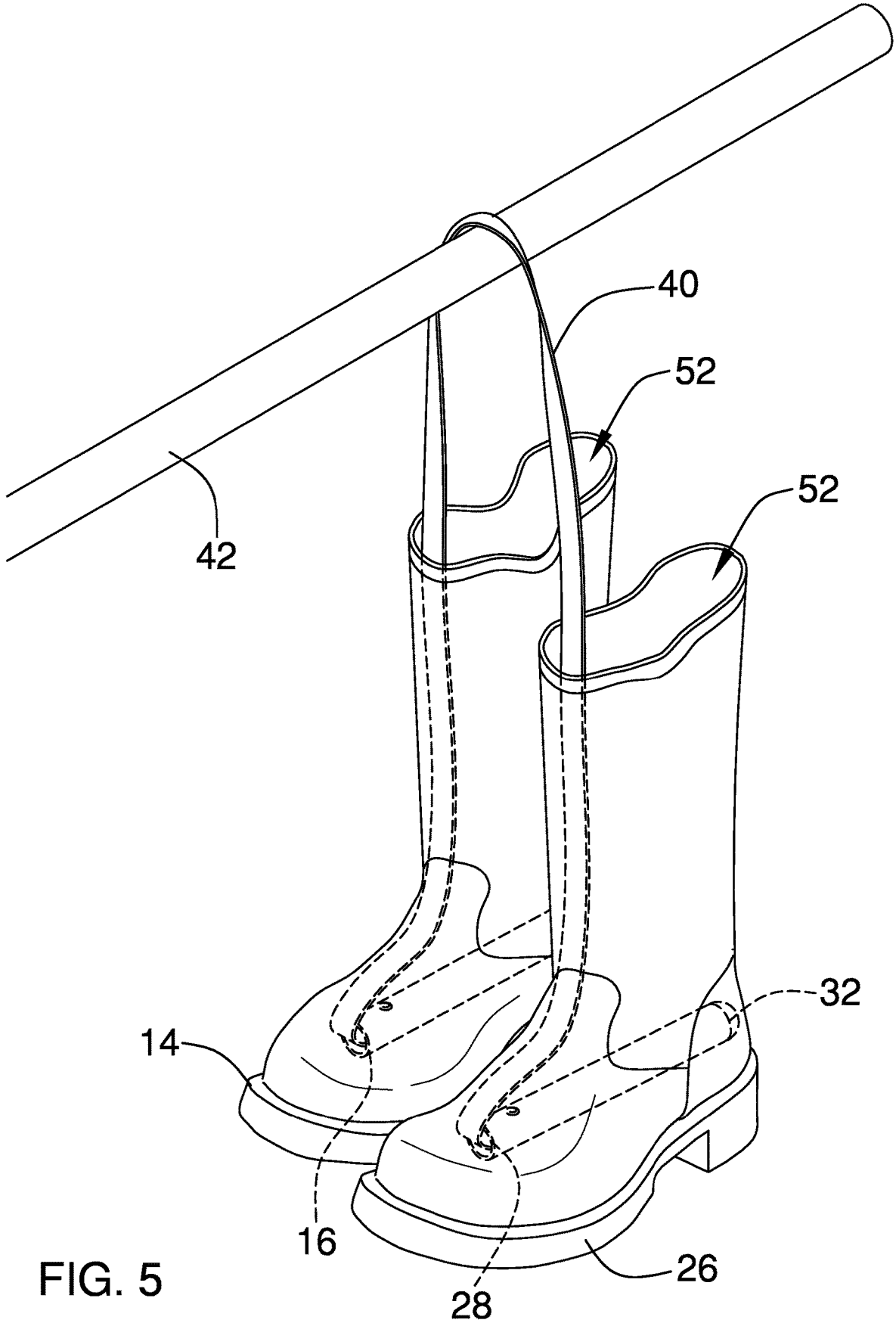
FIG. 5 is an isometric in-use view of an embodiment of the disclosure.

In an embodiment shown in FIG. 2, the tether 40 has a first attached end 44 and a second attached end 46 wherein the tether 40 extends through the first ends 16, 28 such that the first attached end is 44 positioned within the first rod 12 and the second attached end 48 is positioned within the second rod 24. A first coupler 48 engages the first rod 12 and the tether 40 adjacent to the first attached end 44 and a second coupler 50 engages the second rod 24 and the tether 40 adjacent to the second attached end 46. The couplers 48, 50 may include any conventional coupling means such as adhesives, staples and the like. The couplers 48, 50 of FIG. 2 comprise a rivet extending into the first 12 and second 24 rods. Alternatively, the tether 40 may be attached to a closed first end of a rod variant or may be extended completely through the second ends 20, 32 and the coupler comprises a stop or knot tied in the tether 40.

In use, the first 12 and second 24 rods are extended into the first 14 and second 26 foot coverings as described above and shown in the Figures. The tether 40, being pulled upwardly through an ankle opening 52 of the first 14 and second 26 foot coverings, causes the first ends 16, 28 to abut the vamps 36 while the second ends 20, 32 abut and frictionally engage the heel counters 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method for storing footwear comprising the steps of:

extending a first rod into a first foot covering such that a first end of the first rod is in a toe area of the first foot covering and a second end of the first rod is positioned in a heal area of the first foot covering;

extending a second rod into a second foot covering such that a first end of the second rod is in a toe area of the second foot covering and a second end of the second rod is positioned in a heal area of the second foot covering; and extending a tether attached to the first ends of the first and second rods over a support such that the first and second foot coverings are suspended from the support.

2. A method for storing footwear comprising the steps of:

extending a first rod into a first foot covering such that a first end of the first rod is in a toe area of the first foot covering and a second end of the first rod is positioned in a heal area of the first foot covering;

extending a second rod into a second foot covering such that a first end of the second rod is in a toe area of the second foot covering and a second end of the second rod is positioned in a heal area of the second foot covering, each of the first and second rods being elongated and having a length between 5.0 inches and 10.0 inches; and extending a tether attached to the first ends of the first and second rods over a support such that the first and second foot coverings are suspended from the support, the tether having a length from the first rod to the second rod being between 30.0 inches and 60.0 inches.

3. A method for storing footwear comprising the steps of:

extending a first rod into a first foot covering such that a first end of the first rod is in a toe area of the first foot covering and a second end of the first rod is positioned in a heal area of the first foot covering;

extending a second rod into a second foot covering such that a first end of the second rod is in a toe area of the second foot covering and a second end of the second rod is positioned in a heal area of the second foot covering, the first and second rods each being elongated and having a length between 5.0 inches and 10.0 inches, each of the rods having a cylindrical shape, the first ends of the first and second rods being open; and extending a tether attached to the first ends of the first and second rods over a support such that the first and second foot coverings are suspended from the support, the tether having a length from the first rod to the second rod being between 30.0 inches and 60.0 inches, the tether having a first attached end and a second attached end, the tether extending through the first ends such that the first attached end is positioned within the first rod and the second attached end is positioned within the second rod, a first coupler engaging the first rod and the tether adjacent to the first attached end and a second coupler engaging the second rod and the tether adjacent to the second attached end.

* * * * *